US006019053A

United States Patent [19]

Kawaguchi

[11] Patent Number: 6,019,053

[45] **Date of Patent: *Feb. 1, 2000**

[54] CURVED WORKPIECE FABRIC HOLDER DEVICE CAPABLE OF ENLARGING EMBROIDERY STITCHING AREA FOR USE IN EMBROIDERY MACHINE

[75] Inventor: Yasuhiko Kawaguchi, Gifu-ken, Japan

[73] Assignee: Brother Kogyo Kabushiki Kaisha, Nagoya, Japan

[ * ] Notice: This patent is subject to a terminal disclaimer.

[21] Appl. No.: 09/047,365

[22] Filed: Mar. 25, 1998

[30] Foreign Application Priority Data

Mar. 28, 1997 [JP] Japan ..... 9-095095

[51] Int. Cl.[7] ..... D05C 9/04

[52] U.S. Cl. ..... 112/103; 112/155; 112/470.18

[58] Field of Search ..... 112/103, 470.06, 112/470.09, 470.14, 470.18, 102, 102.5, 475.11, 63, 10, 309, 318, 155

[56] References Cited

U.S. PATENT DOCUMENTS 5,553,560 9/1996 Tajima et al. .

FOREIGN PATENT DOCUMENTS 8-232158 9/1996 Japan .

*Primary Examiner*—Peter Nerbun
*Attorney, Agent, or Firm*—Oliff & Berridge, PLC

[57] ABSTRACT

A curved workpiece fabric holder device which holds a cup-shaped or cylindrical workpiece at a position around a cylinder bed. The cylinder bed contain therein a loop taker which co-operates with a sewing needle. The holder device includes a base frame movable in an extending direction of the cylinder bed, a rotary frame rotatably supported by the base frame and positioned around the cylinder bed, a retainer retaining therein the workpiece and detachably installed over the rotary frame. The holder device also include a translation mechanism for translating the movement of a fabric feed frame in an X-direction into a rotational movement of the rotary frame. The translation mechanism includes a wire looping around the rotary frame, and having one end fixed to a first wire attaching portion and having another end fixed to a second wire attaching portion. Each end portion of the wire extends up to an outer edge of each wire attaching portion, and is turned at each outer edge in a hairpin manner, so that each distal end of the wire is fixed to an intermediate portion of each wire attaching portion.

14 Claims, 9 Drawing Sheets

COMPARATIVE ART

CURVED WORKPIECE FABRIC HOLDER DEVICE CAPABLE OF ENLARGING EMBROIDERY STITCHING AREA FOR USE IN EMBROIDERY MACHINE

BACKGROUND OF THE INVENTION

The present application is closely related to a commonly assigned copending U.S. patent application Ser. No. 09/047,215 U.S. Pat. No. 5,884,572 (corresponding to a Japanese Patent Application No. Hei-9-95094 entitled "Curved workpiece fabric holder device having rotary position adjusting mechanism for rotary frame for use in embroidery machine".

The present invention relates to a curved workpiece fabric holder device for holding a cup-shaped or cylindrical workpiece fabric such as a cap in order to perform embroidery stitching onto the workpiece while rotating the same about its axis.

A multiple-head type embroidery machine is provided for performing embroidery stitching to a plurality of workpieces simultaneously. The multiple-head type embroidery machine includes a plurality of embroidery machines, a plurality of cylinder beds, a fabric feed frame movable in a Y-direction(frontward/rearward direction) in parallel with an extending direction of the cylinder beds and an X-direction (lateral direction) perpendicular to the Y-direction, and an embroidery frames detachably installed onto the fabric feed frame for fixing workpieces at embroidery stitching positions. Further, a curved workpiece fabric holder device is provided for each embroidery machine so as to hold a curved workpiece fabric in order to perform embroidery stitching to each curved workpiece fabric while retaining the curved workpiece fabric in the holder device. A cup-shaped or a cylindrical workpiece can be referred to as the curved workpiece fabric. For example, a cap is a typical example of the cup-shaped workpiece.

As described in a Japanese Patent Application Kokai No. Hei-8-232158, a conventional curved workpiece fabric holder includes a base frame positioned adjacent the cylinder bed and movable in the Y-direction, a rotary frame rotatable about an axis extending in the Y-direction, a workpiece retainer detachably mounted on the rotary frame for fixing the curved workpiece at an embroidery stitching position, and a translation mechanism for translating a linear movement of the fabric feed frame in the X-direction into the rotating motion of the rotary frame. The base frame is linked to the fabric feed frame through a link mechanism, so that the base frame and the rotary frame can be driven in the Y-direction concurrently with the movement of the fabric feed frame in the Y-direction.

The translation mechanism includes a pair of right and left link plates releasably fixed to the fabric feed frame, a connecting rod movably connected to the base frame for connecting together the right and left link plates, and a wire partly wound over the rotary frame and having each end fixed to each link plate.

The wire looped around the rotary frame extends from a top end of the rotary frame toward each link plate fixed to a fabric feed frame, so that each end of the wire is fixed to each lower surface of the link plate by a fastener such as a screw.

If the pair of link plates are moved in the X-direction in accordance with the movement of the fabric feed frame, the rotary frame around which the wire is looped or wound is rotated about its axis, so that the curved workpiece and the retainer are also rotated. Thus, a desired stitching area can be brought into confrontation with a sewing needle.

In case a plurality of workpieces are to be stitched, a plurality of holder devices are mounted on the multiple head type embroidery machine. Here a distance between neighboring heads of the neighboring sewing machines is set in a predetermined distance, such as about 600 mm. In this connection, a pair of link plates for each holder device for fixing ends of each wire are set to the fabric feed frame in such a manner that the pair of link plates are not mechanically interfered with the neighboring link plates of different pairs. In each holder device, both fixed ends of the wire and the upper end of the rotary frame are aligned with each other in a horizontal direction. Because the rotary frame is not movable in the X-direction, the movement of the fabric feed frame in the X-direction causes rotation of the rotary frame through the translation mechanism.

Here, the embroidery stitching area is determinative by the rotation angle range of the rotary frame. That is, if the rotation angle range of the rotary frame is increased, the embroidery stitching area can be increased. In other words, the stitching area is determinative by the moving stroke of the fabric feed frame in the X-direction.

Further, the rotation angle range of the rotary frame is also dependent on a distance between the pair of link plates. If the pair of link plates are positioned far away from each other, a relatively long wire can be used so that rotation angle of the rotary frame can be increased. However, as described above, a distance between the pair of link plates is limited to avoid mechanical interference if a plurality of holder devices are installed onto the multiple head type embroidery machine. Therefore, it would be rather difficult to increase embroidery stitching area in the concurrent stitching in the multiple head type embroidery machine.

SUMMARY OF THE INVENTION

It is therefore an object of the present invention to provide a curved workpiece fabric holder device capable of enlarging angular rotation range of the rotary frame to expand an embroidery stitching area.

This and other objects of the present invention will be attained by a curved workpiece fabric holder device for use in an embroidery machine having at least one cylinder bed extending in a frontward/rearward direction, and a fabric feed frame movable in the frontward-rearward direction and a lateral direction perpendicular thereto, the holder device including a base frame, a rotary frame, a workpiece retainer, and a translation mechanism. The base frame is positioned adjacent the cylinder bed and movable in the frontward/rearward direction. The rotary frame is rotatably supported by the base frame and is positioned to surround the cylinder bed. The rotary frame has an uppermost end. The workpiece retainer is adapted for retaining a curved workpiece and is detachably mounted on the rotary frame. The translation mechanism is connected between the fabric feed frame and the rotary frame for translating the movement of the fabric feed frame in the lateral direction into a rotational movement of the rotary frame. The translation mechanism includes a wire and a pair of first and second wire attaching portions. The wire loops around the rotary frame and has one end area portion extending from the uppermost end of the rotary frame away from the rotary frame in the lateral direction, and has another end area portion extending from the uppermost end of the rotary frame opposite away from the rotary frame in the lateral direction. The wire has one and another distal ends. The pair of first and second wire attaching portions are spaced away from each other in the lateral direction and are supported to the fabric feed frame. The first and second wire attaching portions have outermost edges in the lateral direction. The one end area portion of the wire leads up to the outermost edge of the first wire attaching portion, and the one distal end of the wire is fixed to the first wire attaching portion. The another end area portion of the wire leads up to the outermost edge of the second wire attaching portion, and the another distal end of the wire is fixed to the second wire attaching portion.

In another aspect of the invention, there is provided a multiple head type embroidery machine for performing embroidery stitching simultaneously to a plurality of curved workpiece fabrics, the multiple head type embroidery machine including a plurality of embroidery heads arrayed side by side in a lateral direction. Each embroidery head has a plurality of needle bars each holding a sewing needle and a cylinder bed extending in a frontward/rearward direction and housing therein a loop taker. An embroidery stitching is formed by co-operation of the sewing needle and the loop taker. The multiple head type embroidery machine also includes a fabric feed frame movable in the frontward-rearward direction and a lateral direction perpendicular thereto, and a plurality of holder devices. Each holder device includes the above described base frame, rotary frame, workpiece retainer, and translation mechanism.

DETAILED DESCRIPTION OF THE PREFERRED EMBODIMENT

A curved workpiece fabric holder device according to one embodiment of the present invention will be described with reference to FIGS. 1 through 8. First, in FIG. 1, a multiple-head type embroidery machine which accommodates the holder device is shown. In the multiple-head type embroidery machine, a plurality of cylindrical or cup-shaped workpiece fabrics such as caps are detachably installed on the plurality of the holder devices, and embroidery stitching is performed simultaneously with respect to the caps held on the holder devices.

Figure 1:
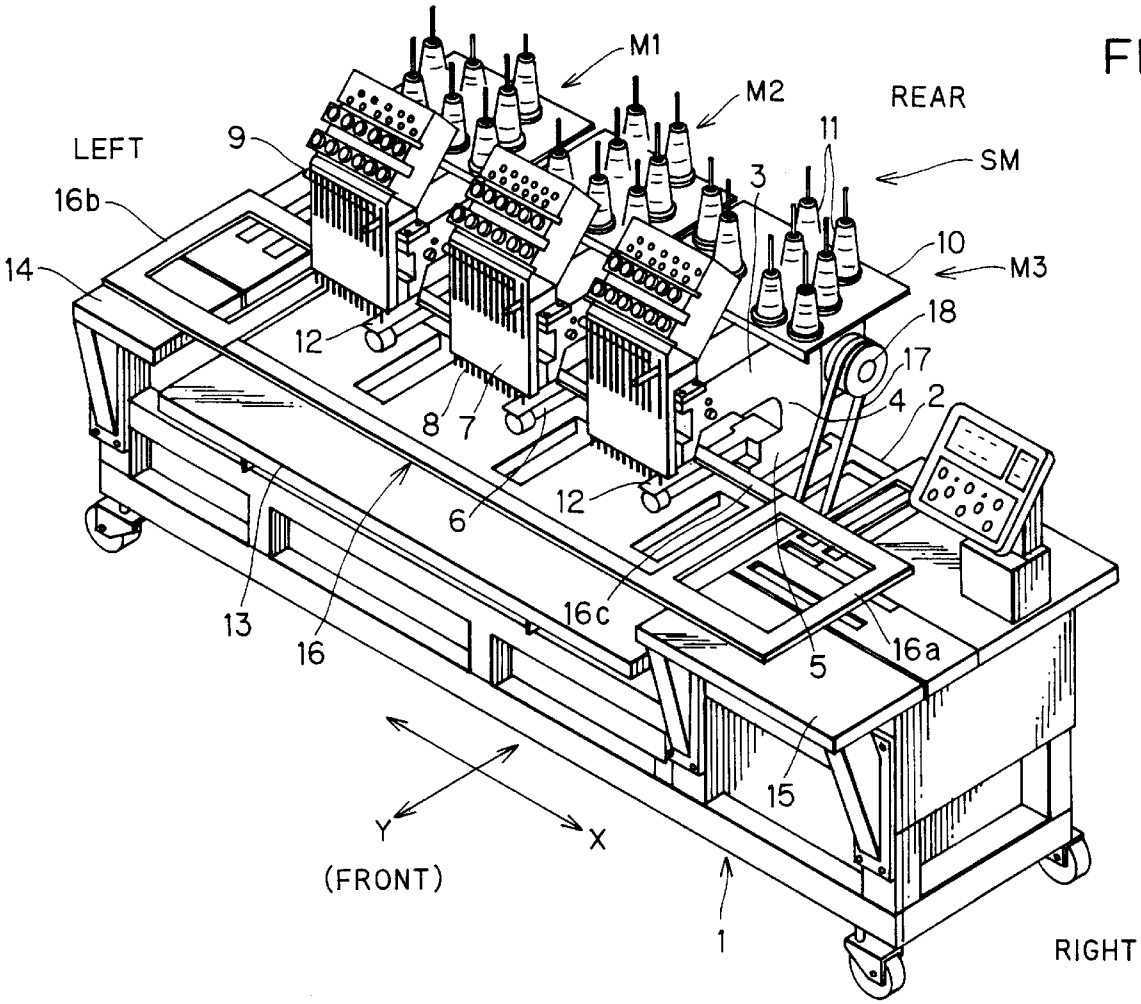
FIG. 1 is a perspective view showing a multiple-head type embroidery machine.

As shown in FIG. 1, the multiple-head type embroidery machine SM includes a base 1 extending in a lateral direction (X-direction), and a sewing machine support frame 2 positioned at an upper rear side of the base 1 and extending in the X-direction. The support frame 2 has a rectangular shape. On the support frame 2, three embroidery machines M1 through M3 each having a plurality of sewing needles are arrayed side by side in the X-direction.

Each of the embroidery machines M1 through M3 has an arm portion 3 and a needle bar case 7 provided at a front end of the arm portion 3. Each needle bar case 7 is movable in the X-direction with respect to the arm portion 3 and supports twelve needle bars and thread take-up levers 9. A vertical post 4 integrally extends downwardly from the arm portion 3, and a main bed portion 5 is integrally provided with a lower end of the vertical post 4. The main bed portion 5 is fixed to the machine support frame 2, and has a front end portion from which a cylinder bed 6 extends frontwardly. Within the cylinder bed 6 and at a position adjacent a free end (front end) portion thereof, a loop taker and components associated therewith are provided. Further, each cylinder bed 6 has a throat plate formed with a needle hole 12.

Each needle bar of each needle bar case 7 has a lower end fixed with a sewing needle 8. Therefore, totally twelve sewing needles 8 are provided per each needle bar case 7. A spool stand 10 is provided for each embroidery machine, and twelve thread spools 11 are rotatably supported on the spool stand 10. The thread spools 11 wind thereover needle threads of different colors, so that totally twelve colors of needle threads are respectively supplied to the corresponding sewing needles 8.

An upper spindle (not shown) is provided for driving a selected one of the needle bars and associated thread take-up lever 9. Further, a loop taker shaft (not shown) is provided for rotationally driving the loop taker. The upper spindle and the loop taker shaft are driven by a drive shaft 18. Further, a sewing machine motor (not shown) is provided, and an endless V-belt 17 driven by the sewing machine motor is mounted on a pulley of the drive shaft 18.

With this arrangement, the needle bar case 7 is moved in the X-direction, so that a selected one of the sewing needles 8 retaining a selected color of the needle thread is brought into alignment with the needle hole 12 at the cylinder bed 6. With this state, only the associated needle bar and the thread take-up lever 9 are vertically reciprocally moved by the rotation of the spindle. As a result, an embroidery stitching with a desired color can be performed in co-operation with the loop taker rotationally driven by the loop taker shaft.

A work table 13 is vertically movably provided at a front side of the support frame 2. The work table 13 can be elevated to a horizontal level coincident with that of an upper surface of the cylinder bed 6. Auxiliary tables 14 and 15 are provided at left and right sides of the work table 13, respectively. Further, a fabric feed frame 16 extending in the X-direction is positioned above the work table 13. The fabric feed table 16 has a right side driving frame **16*a* supported on the right side auxiliary table 15, a left side driving frame 16*b* supported on the left side auxiliary table 14, and a laterally extending frame portion 16*c***.

A driving mechanism(not shown) for driving the fabric feed table 13 in the X-direction is provided in the right side auxiliary table 15 and is connected to the right side driving frame **16*a*. Further, another driving mechanism(not shown) for driving the fabric feed table 13 in frontward/rearward direction (Y-direction) is provided in each auxiliary table 14, 15 and is connected to the right and left side driving frames 16*a*, 16*b***.

Figure 2:
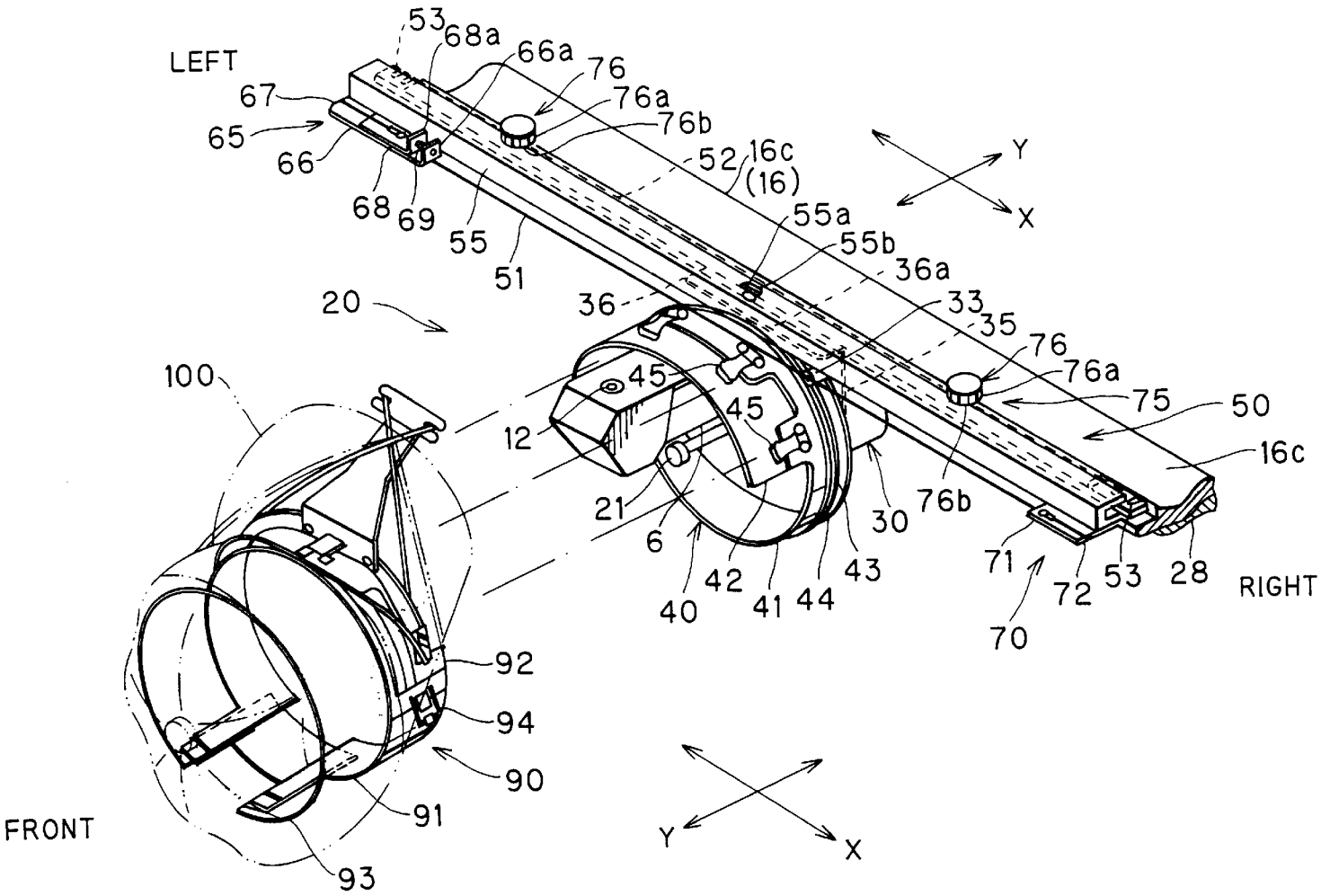
FIG. 2 is a segmental perspective view showing a curved workpiece fabric holder device according to one embodiment of the present invention.
Figure 4:
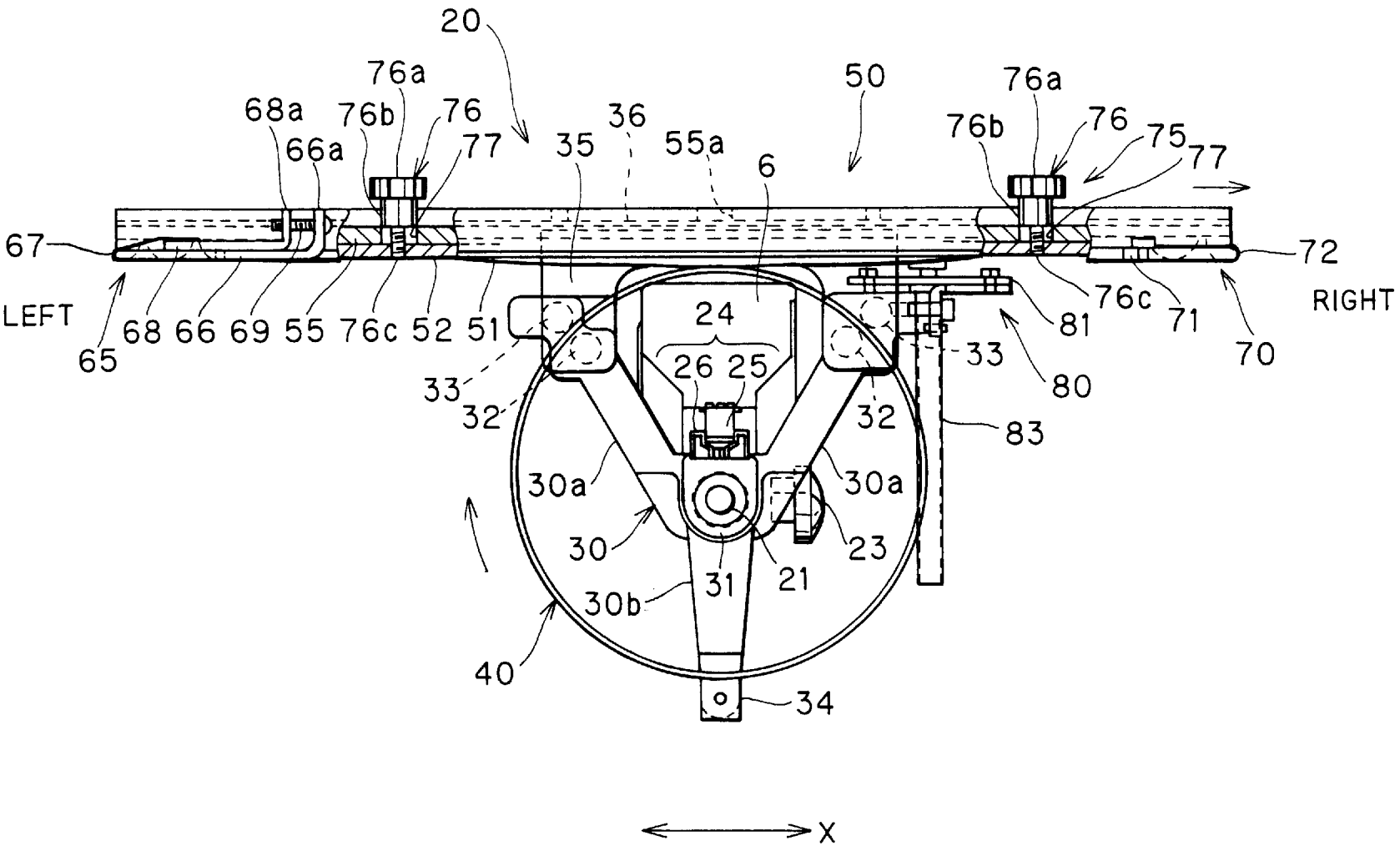
FIG. 4 is a front view showing the curved workpiece fabric holder device according to the embodiment in which a rotary frame is positioned at its point of origin.
Figure 5:
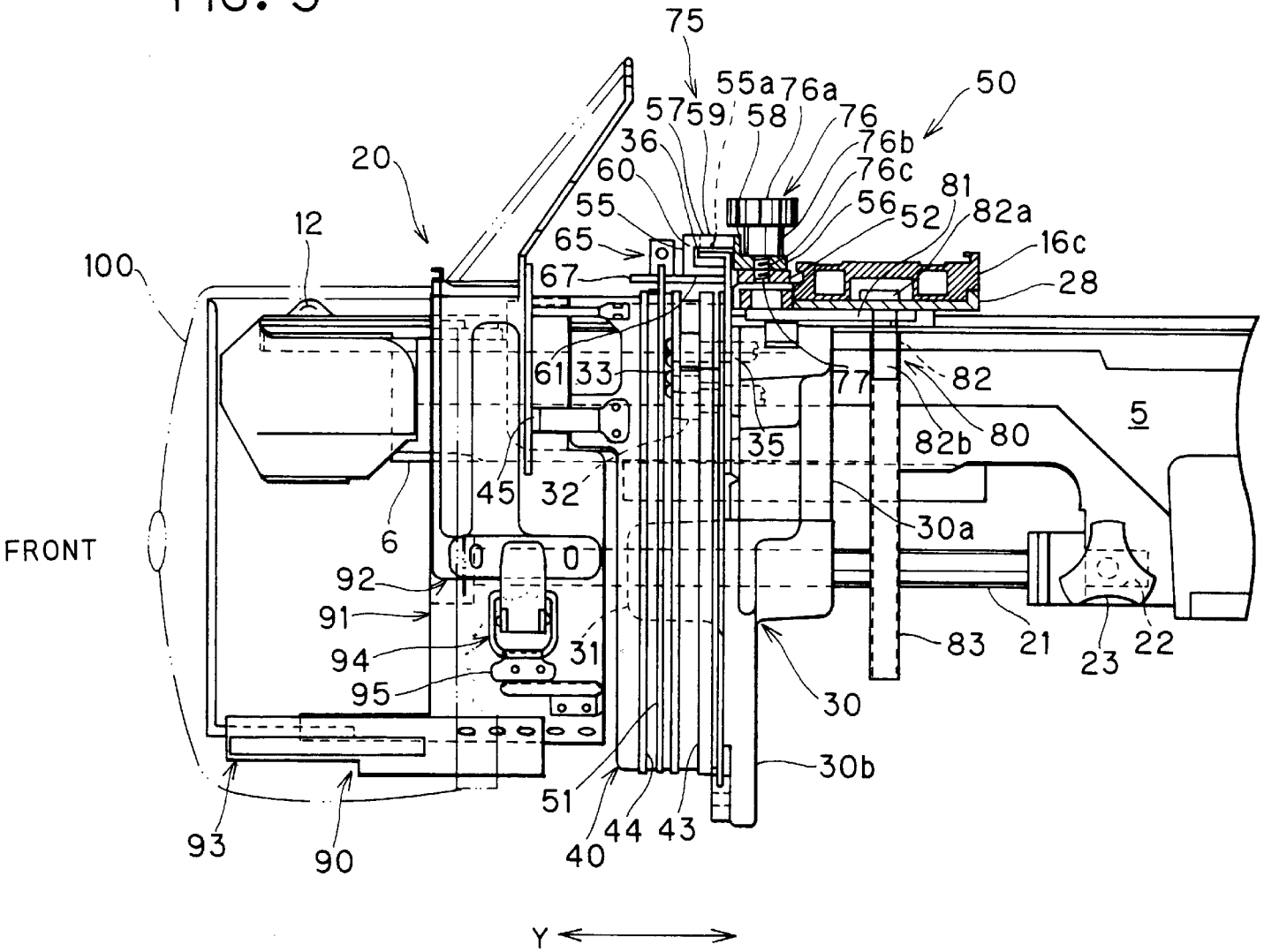
FIG. 5 is a side view showing the curved workpiece fabric holder device according to the embodiment.

Next, a curved workpiece fabric holder device 20 will be described with reference to FIGS. 2 through 8. Each holder device 20 is provided for each embroidery machine M1 through M3. Each holder device 20 includes a guide shaft 21 extending from the main bed portion 5 in the Y-direction at a position below the fabric feed frame 16. As shown in FIGS. 2 and 5, at a front end portion of the main bed portion 5 and at a position adjacent a base end portion of the cylinder bed 6, an insertion hole 22 extending in the Y-direction is formed, and the guide shaft 21 is detachably inserted into the insertion hole 22. The guide shaft 21 is positioned below the cylinder bed 6 and extends in parallel therewith. A fastener 23 is provided to fix the guide shaft 21 to the main bed portion 5. By unfastening the fastener 23, the guide shaft 21 can be released from the insertion hole 22.

The holder device 20 also includes a base frame 30 attached to the guide shaft 21 and movable in the Y-direction, and a rotary frame 40 supported by the base frame 30 and rotatable about an axis extending in the Y-direction. The rotary frame 40 is positioned to surround the cylinder bed 6. The holder device 20 further provides a rotation preventive mechanism 24 (FIG. 4) for restraining rotation of the base frame 30, and a translation mechanism 50 for rotating the rotary frame 40.

The base frame 30 has a central sleeve bearing portion 31 (FIG. 5) slidably disposed over the guide shaft 21 and arm portions 30*a*, 30*a* and 30*b* extending in a radially outward direction of the guide shaft 21. A combination of the arm portions provides a Y-shape in a front view in which a pair of upper arms 30*a* and 30*a* are symmetrical with each other as upwardly extending arms and the other arm 30*b* extends downwardly as shown in FIG. 4. At each upper end portion of the upper arm 30*a*, a pair of inner and outer rollers 32 and 33 are rotatably supported for rotatably supporting the rotary frame 40. That is, the outer rollers 33 are in rolling contact with an outer peripheral surface of the rotary frame 40, and the inner rollers 32 are in rolling contact with an inner peripheral surface of the rotary frame 40. An eccentric mechanism(not shown) is provided for adjusting a position of the outer roller 33 relative to the inner roller 32 in a radial direction thereof. The downwardly extending arm 30*b* has a lower end provided with a guide portion 34 for guiding the rotary frame 40. Further, a linking plate 35 having an upper L-shaped bent portion 36 is fixed to the base frame 30 as shown in FIGS. 1, 4 and 5.

The rotation preventive mechanism 24 is shown in FIG. 4. The mechanism 24 includes a key member 25 and a grooved member 26. The key member 25 is fixed to a lower surface of the cylinder bed 6 and extends in the Y-direction. The grooved member 26 is fixed to the base frame 30, and is adapted to slidably engaged with the key member 25. This engagement prevents the base frame 30 from being rotated about an axis in parallel with the Y-direction during sliding movement of the grooved member 26 with respect to the key member 25.

As described above, the rotary frame 40 is supported by the base frame 30, and is rotatable about an axis extending in the Y-direction. The rotary frame 40 includes an annular portion 41 having a circular cross-section, and a cap retainer support portion 42 having a semi-circular cross-section and extending frontwardly from an upper half portion of the annular portion 41. The annular portion 41 has an outer peripheral portion formed with an annular roller groove 43, and an annular wire guide groove 44. In the roller groove 43, the outer roller 33 provided at the base frame 30 is rollingly fitted, and in the wire guide groove 44 a wire 51 of the translation mechanism 50 (described later) is guided. A lowermost portion of the annular portion 41 is slidably guided by the guide portion 34 provided to the downwardly extending arm 30*b*.

Four engagement rollers 45 are attached to an outer peripheral surface of the annular portion 41 and are urged outwardly in a radial direction of the annular portion 41 by spring members. These engagement rollers 45 are adapted to detachably engage with engagement holes formed in a cap retainer 90 (described later) when the cap retainer 90 is mounted over the cap retainer support portion 42 in order to detachably provide the cap retainer 90 onto the rotary frame 40.

The translation mechanism 50 is adapted to translate the linear movement of the fabric feed frame 16 in the X-direction into rotational movement of the rotary frame 40. The translation mechanism 50 includes the above described wire 51 partly wound around the annular portion 41 of the rotary frame 40, a fixed segment 52, a movable segment 55 and a link-adjusting mechanism 75.

The fixed segment 52 is an elongated member extending in the X-direction and is releasably fixed to the fabric feed frame 16. More specifically, at each longitudinal end portion of the fixed segment 52, a linking bore 53 is formed. Further, screwed knobs (not shown) are threadingly engaged with the laterally extending frame portion 16*c*, and are engaged into the respective linking bores 53. Thus, the fixed segment 52 is fixed to the laterally extending frame portion 16*c* of the fabric feed frame 16.

The movable segment 55 is also an elongated member extending in the X direction and is movable in the X-direction with respect to the base frame 30. The movable segment 55 has one longitudinal end portion provided with wire attaching portion 65 to which one end of the wire 51 is attached, and the segment 55 has another longitudinal end portion provided with another wire attaching portion 70 to which another end of the wire 51 is attached. The link-adjusting mechanism 75 is adapted for adjusting a fixed position of the movable segment 55 in the X-direction with respect to the fixed segment 52, i.e., with respect to the base frame 30.

Figure 6:
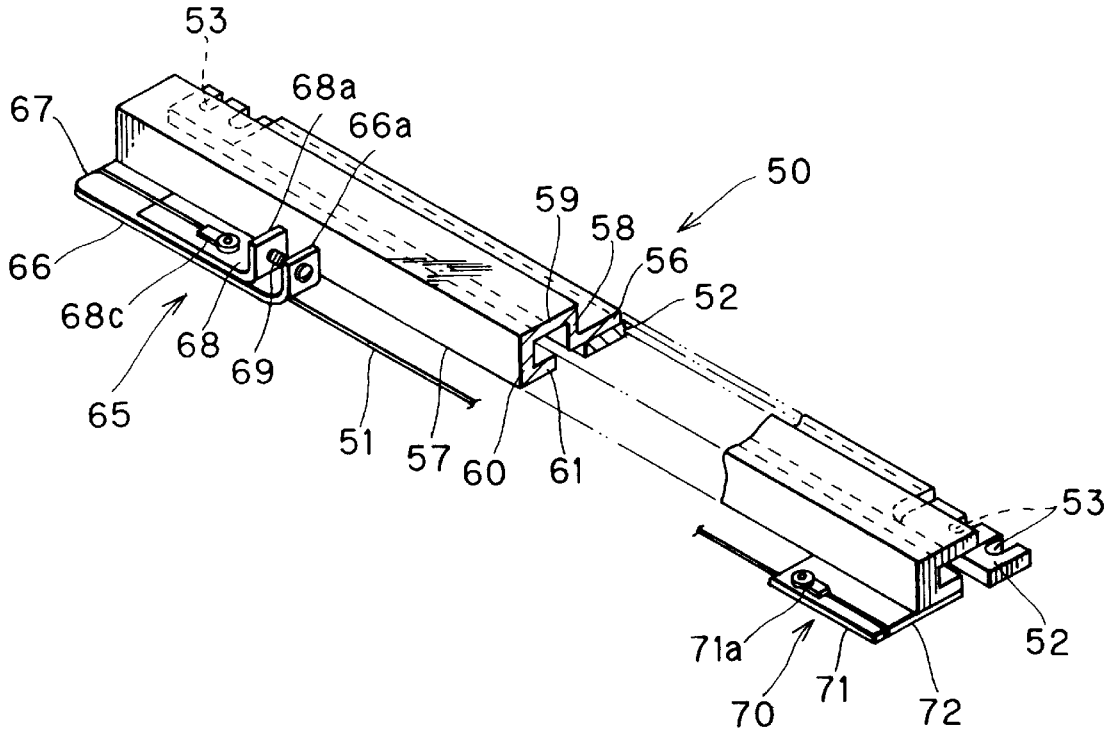
FIG. 6 is an enlarged segmental perspective view showing an essential portion of the curved workpiece fabric holder device according to the embodiment.

As shown in FIGS. 5 and 6, the movable segment 55 has a horizontal plate portion 56 and an engaging portion 57. The horizontal plate portion 56 is positioned in surface abutment with the fixed segment 52, and has a longitudinal length smaller than that of the fixed segment 52. That is, the horizontal plate portion 56 does not cover the longitudinal end portions of the fixed segment at which the linking bores 53 are formed.

The engaging portion 57 is positioned at a front side of the horizontal plate portion 56 integrally therewith, and is adapted to engage the L-shaped bent portion 36 of the linking plate 35 fixed to the base frame 30. As best shown in FIG. 5, the engaging portion 57 defines an U-shaped engagement recess in cross-section engageable with the L-shaped bent portion 36. That is, the engaging portion 57 includes an upwardly projecting portion 58 projecting upwardly from a front edge of the horizontal plate portion 56, an upper horizontal portion 59 projecting frontwardly from an upper edge of the upwardly projecting portion 58, a vertical portion 60 projecting downwardly from the front edge of the upper horizontal portion 59, and a lower horizontal portion 61 projecting rearwardly from the lower edge of the vertical portion 60. Thus, the U-shaped engagement recess is provided.

The lower horizontal portion 61 has a projecting length (Y-direction) smaller than that of the upper horizontal portion 59. A space is provided between a rear edge of the lower horizontal portion 61 and the front edge of the fixed segment 52 and between the rear edge of the lower horizontal portion 61 and the front surface of the upwardly projecting portion 58. Thus, the L-shaped bent portion 36 of the linking plate 35 can be inserted into the U-shaped engagement recess, i.e., the engaging portion 57. Accordingly, even if the entire curved workpiece fabric holder device 20 is removed from the multiple-head type embroidery machine SM, the fixed segment 52, the movable segment 55 and the wire 51 can provide a predetermined linking relationship with the base frame 30.

The left side wire attaching portion 65 provided at the left end of the movable segment 55 includes a link plate 66 fixed to a lower surface of the movable segment 55, and a movable link piece 68 mounted on the link plate 66 and movable in the X-direction with respect to the upper surface of the link plate 66. The left end of the wire 51 is fixed to the link piece 68. The link plate 66 extends horizontally in the X-direction and projects frontwardly from the front edge of the movable segment 55. The link plate 66 has a right end portion having an upstanding bent portion 66*a* to which a screw 69 is rotatably and unreleasably supported. The link plate 66 has a leftmost edge 67.

The link piece 68 has a right end portion having an upstanding bent portion 68*a* in confrontation with the upstanding bend portion 66*a* and formed with a female thread threadingly engageable with the screw 69. By the rotation of the screw 69, the link piece 68 is moved in the X-direction on the link plate 66. A top surface of the link piece 68 has a wire fixing portion 68*c* (FIG. 6) to which the leftmost end of the wire 51 is fixed.

The left end area portion of the wire 51 extends along and beneath the link plate 66 and is turned or bent like a hairpin at the leftmost edge 67, so that the left end of the wire 51 is positioned above the link piece 68. The leftmost end of the wire 51 is fixed to the link piece 68 by the wire fixing portion 68*c*.

The right side wire attaching portion 70 provided at the right end of the movable segment 55 includes a link plate 71 fixed to the lower surface of the movable segment 55 and projecting frontwardly. The link plate 71 has a rightmost edge 72 and a top surface at which a wire fixing portion 71*a* is provided. The right end area portion of the wire 51 extends along and beneath the link plate 71 and is turned or bent like a hairpin at the rightmost edge 72, so that the right end of the wire 51 is positioned above the link plate 71. The rightmost end of the wire 51 is fixed to the link plate 71 by the wire fixing portion 71*a*. Accordingly, both left and right ends of the wire 51 are fixed to the wire attaching portions 65 and 70. By threadingly advancing the screw 69 with respect to the link piece 68, the link piece 68 is moved rightwardly, so that tension applied to the wire 51 can be increased. By properly controlling the tension of the wire 51, the rotary frame 50 can be rotated in synchronism with the movement of the fabric feed frame 16 in X-direction without any slippage of the wire 51 over the annular wire guide groove 44.

As described above, the link-adjusting mechanism 75 is adapted for adjusting a fixed position of the movable segment 55 in the X-direction with respect to the fixed segment 52, i.e., with respect to the base frame 30. As shown in FIGS. 4 and 5, the link-adjusting mechanism 75 is constituted by a pair of screwed knobs 76 and a pair of elongated slots 77, 77 elongated in the X-direction and formed in the movable segment 55. Each screwed knob 76 includes a knob portion 76*a*, a large diameter stem portion 76*b* positioned immediately below the knob portion 76*a*, and a screwed portion 76*c* positioned immediately below the stem portion 76*b*. As best shown in FIG. 5, a diameter of the large diameter stem portion 76*b* is greater than a width of the slot 77, and the screwed portion 76*c* can pass through the slot 77 and threadingly engage the fixed segment 52. Therefore, when the knob portion 76*a* is rotated in one direction so as to allow the screwed portion 76*c* to be threadingly engaged with the fixed segment 52, the movable segment 55 is clamped between the lower surface of the large diameter stem portion 76*b* and the upper surface of the fixed segment 51, that is, the movable segment 55 is fixed to the fixed segment 51. On the other hand, if the knob portion 76*a* is rotated in the reverse direction, the lower surface of the stem portion 76*b* is moved away from the movable segment 55, so that the movable segment 55 can be movable in the X-direction relative to the fixed segment 55 within the length of the elongated slots 77.

For setting a rotational point of origin of the rotary frame 40, datum lines 55*b* and 36*a* (FIG. 3) are provided. More specifically, at a longitudinally center portion of the movable segment 55, an elongated slot 55*a* elongated in the X-direction is formed. The datum line 55*b* extends in the Y-direction, and is provided on the upper surface of the movable segment 55 at a position frontward and rearward of the elongated slot 55*b*. The other datum line 36*a* extends in the Y-direction, and is provided on the upper surface of the L-shaped bent portion 36 of the linking plate 35. The other datum line 36*a* is visible through the elongated slot 55*a*.

Figure 3:
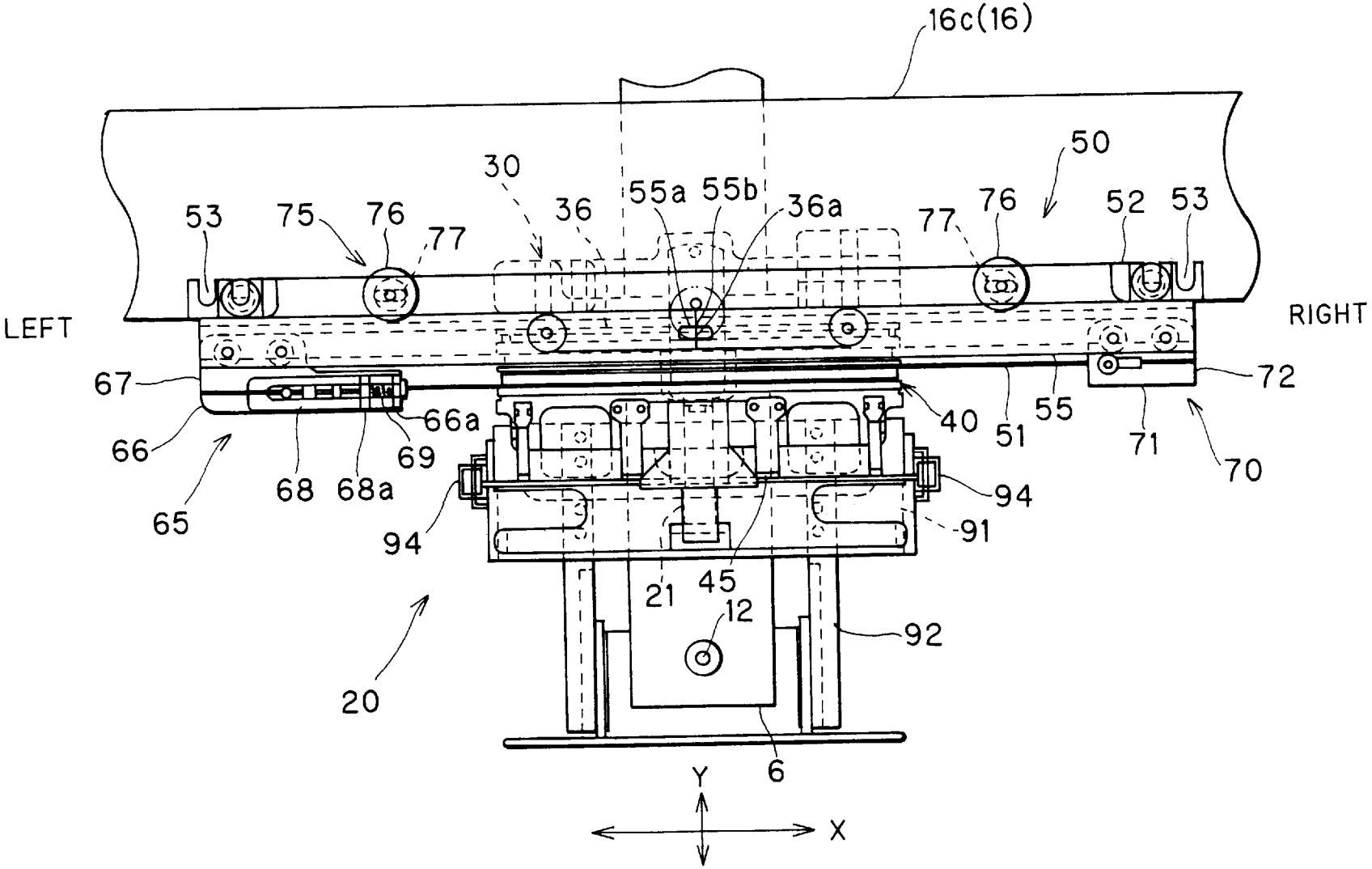
FIG. 3 is a plan view showing the curved workpiece fabric holder device according to the embodiment.

The rotational point of origin of the rotary frame 40 is provided when the datum line 36*a* is brought into alignment with the datum line 55*b* of the movable segment 55 as shown in FIG. 3. In this state, the screwed knobs 76 do not clamp the movable segment 55 to the fixed segment 52 so that the movable segment 55 is movable in the X direction, and at the same time, the relative position between the movable segment 55 and the fixed segment 52 is such that each screwed portion 76*c* is positioned at a longitudinally center point of each elongated slot 77 as shown in FIG. 4.

Figure 7:
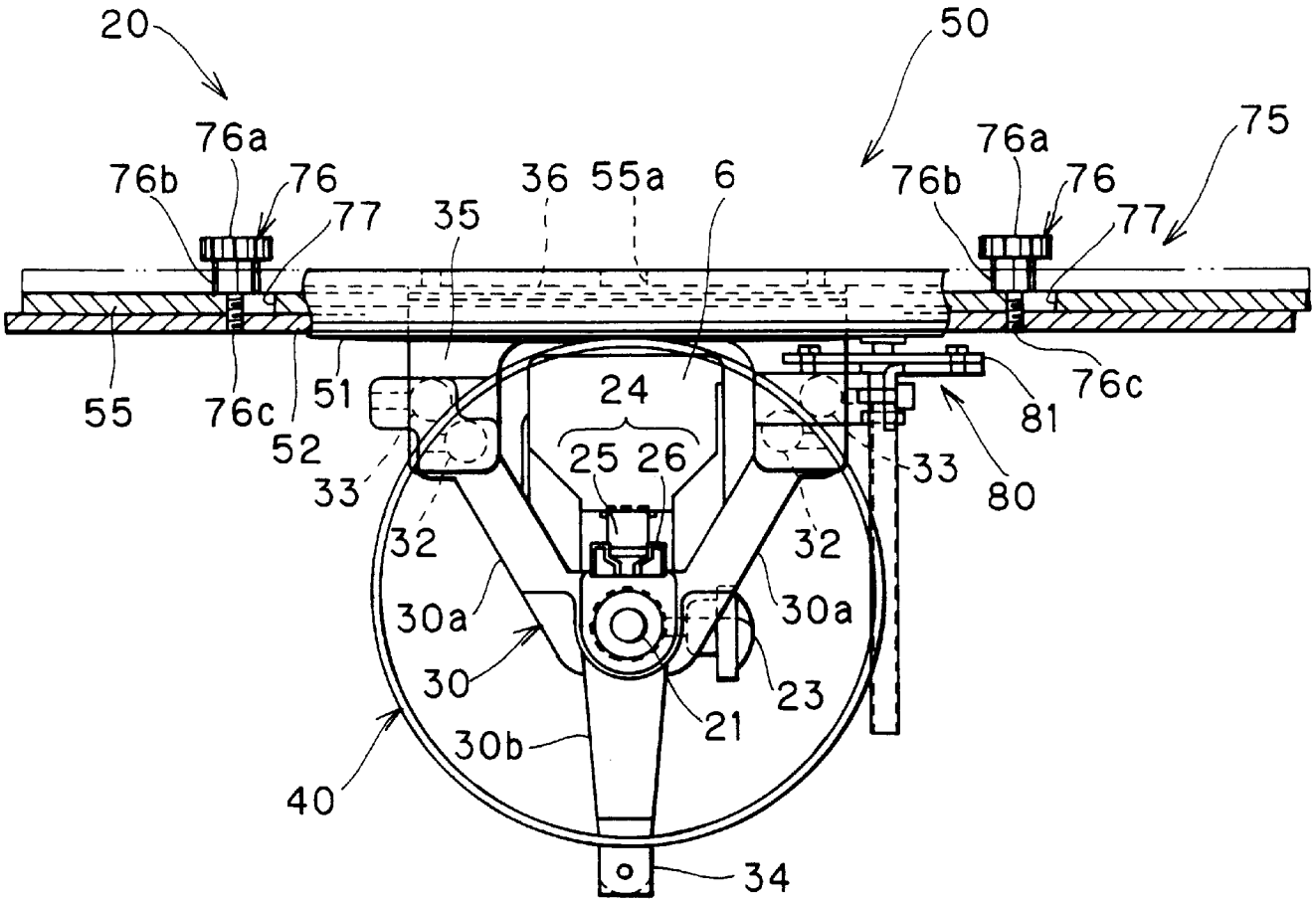
FIG. 7 is a front view showing the curved workpiece fabric holder device according to the embodiment in which the rotary frame is positioned offset from its point of origin.

The point of origin of the rotary frame 40 can be changed or adjusted in the following manner. First, the movable segment 55 is unclamped from the fixed segment 52 by unfastening the link-adjusting mechanism 75. Then, the rotary frame 40 is manually rotated about its axis. Because the wire 51 is wound around the rotary frame 40 and both ends of the wire 51 are fixed under tension to the longitudinal end portion of the movable segment 55, the movable segment 55 is moved in the X-direction by the rotation of the rotary frame 40. For example, if the rotary frame 40 is rotated in a clockwise direction in FIG. 4, the movable segment 55 is moved rightwardly. Thus, the datum line 55*b* is offset from the datum line 36*a* to thus change the point of origin. Instead of manual rotation of the rotary frame 40, the movable segment 55 can be manually moved in the X-direction so as to rotate the rotary frame 40 about its axis. By the latter method also, the point of origin of the rotary frame 40 can be adjusted. Apparently, the above described adjustment can be made independently of each holder device 20 of each embroidery machine SM. Incidentally, FIG. 7 shows a state in which the movable segment 55 is moved to its rightmost position with respect to the fixed segment 52. In this case, the screwed portion 76*c* abuts the left end of the elongated slot 77.

The holder device 20 further includes a linking mechanism 80 for linking the base frame 30 to the fabric feed frame 16. That is, the linking mechanism 80 connects the base frame 30 to the fabric feed frame 16 so as to move the base frame 30 in the Y-direction in accordance with the concurrent movement of the fabric feed frame 16 in the Y-direction. As shown in FIGS. 2 and 5, a linking liner 28 is fixed to a lower surface of the laterally extending frame portion 16*c* of the fabric feed frame 16. Further, a coupling plate 81 is fixed to the base frame 30 and is disposed below the linking liner 28. A flanged shaft 82 having a flanged portion 82*a* and a shaft portion 82*b* is supported by the coupling plate 81. An operation lever 83 is provided whose upper portion is rotatably supported to the shaft portion 82*b* of the flanged shaft 82. The flanged shaft 82 is movable in a vertical direction so as to selectively link the coupling plate 81 to the linking member 28. For example, if the flanged shaft 82 is shifted to its fixing position upon manipulation of the operation lever 83, the flanged shaft 82 is moved downwardly by a clamp mechanism (not shown). Thus, the flange portion 82*a* fixes the coupling plate 81 to the linking liner 28. Therefore, the base frame 30 can be linked to the fabric feed frame 16 by means of the linking mechanism 80, whereby the base frame 30 can be moved in the Y-direction by the movement of the fabric feed frame 16 in the Y-direction.

The holder device 20 further includes the cap retainer 90 detachably mounted on the rotary frame 40. The cap retainer 90 includes a main retainer body 91, a pressure frame member 92, and a shape keeping member 93. The main retainer body 91 has a generally circular shape, and is adapted to be detachably disposed over the rotary frame 40. Four engagement holes are formed in the main retainer body 91 to be engaged with the four engagement rollers 45 of the rotary frame 40. The pressure frame member 92 is detachably disposed over the main retainer body 91 for interposing a cap 100 therebetween. To this effect, the pressure frame member 92 has a pair of clip members 94 and a pair of hooks 95. The cap 100 can be tightly held by the pressure frame member 92 onto the main retainer body 91 by hooking each clip member 94 with each hook 95. The shape keeping member 93 is provided to the main retainer body 91 in axial alignment therewith in order to keep or expand the cap 100.

In order to attach the cap 100 to the cap retainer 90, an external preparatory station (not shown) is provided where a cap retainer setting frame (not shown) is provided to which the main retainer body 91 is fixed. Generally, the cap 100 has an internal sweat band (not shown) whose lower edge circle portion is stitched to the inner bottom portion of the cap 100. The sweat band is folded down from within the cap 100, so that the sweat band projects downwardly from the bottom edge of the cap 100. With this state, the cap 100 is attached onto the main retainer body 91 fixed to the cap retainer setting frame in such a manner that the bottom open end of the cap 100 is advancing over the outer surface of the main retainer body 91.

Then, a circular center of the cap 100 is aligned with a circular center of the main retainer body 91, and then each clip member 94 is hooked with each hook 95. Immediately before hooking, a front center portion and pair of right and left sides of the fabric of the cap 100 are stretched, so that no wrinkles are generated thereat. Thus, the cap 100 is tightly fixed to the cap retainer 90. Then, the cap retainer 90 is mounted over the rotary frame 40.

If the fabric feed frame 16 is driven to be moved in the Y-direction, the base frame 30 and the rotary frame 40 are also moved in the Y-direction by way of the linking mechanism 80. If the fabric feed frame 16 is driven to be moved in the X-direction, the rotary frame 40 is rotated about its axis by way of the translation mechanism 50. Therefore, the cap 100 is also rotated to provide a desired embroidery stitching onto the cap 100.

If the cap retainer 90 retaining the cap 100 is mounted onto the rotary frame 40, and if the center of the cap 100 is displaced from the center of the cap retainer 90, the movable segment 55 is adjustingly moved in the X direction relative to the fixed segment 52 i.e., relative to the base frame 30 by employing the link-adjusting mechanism 75. Accordingly, the rotary frame 40 can be adjustably rotated by way of the wire 51, thereby adjusting a rotational point of origin of the rotary frame 40. By unclamping the screwed knob 76, the movable segment 55 can become moved in the X direction relative to the fixed segment 52. In this case, because the movable segment 55 is not fixed to the fixed segment 52, only the movable segment 55 is moved without any movement of the large fabric feed frame 16.

In the multiple head type embroidery machine SM, three machines M1 through M3 can be simultaneously driven to simultaneously perform embroidery stitching to three caps 100. Because each embroidery machine has each cap holder device 20, even if one of the caps 100 is attached in an off-centered manner, only the defective cap 100 can be subjected to adjustment of point of origin independent of the other embroidery machines without any movement of the fabric feed frame 16. As a result, all three caps 100 can be simultaneously subjected to embroidery stitching at their proper stitching areas.

Further, clamping or unclamping of the movable segment 55 with respect to the fixed segment 52 can be easily performed by simple manipulation of the screwed knob 76 of the link-adjusting mechanism 75, which facilitates adjustment of the rotational point of origin of the rotary frame 40.

Figure 9:
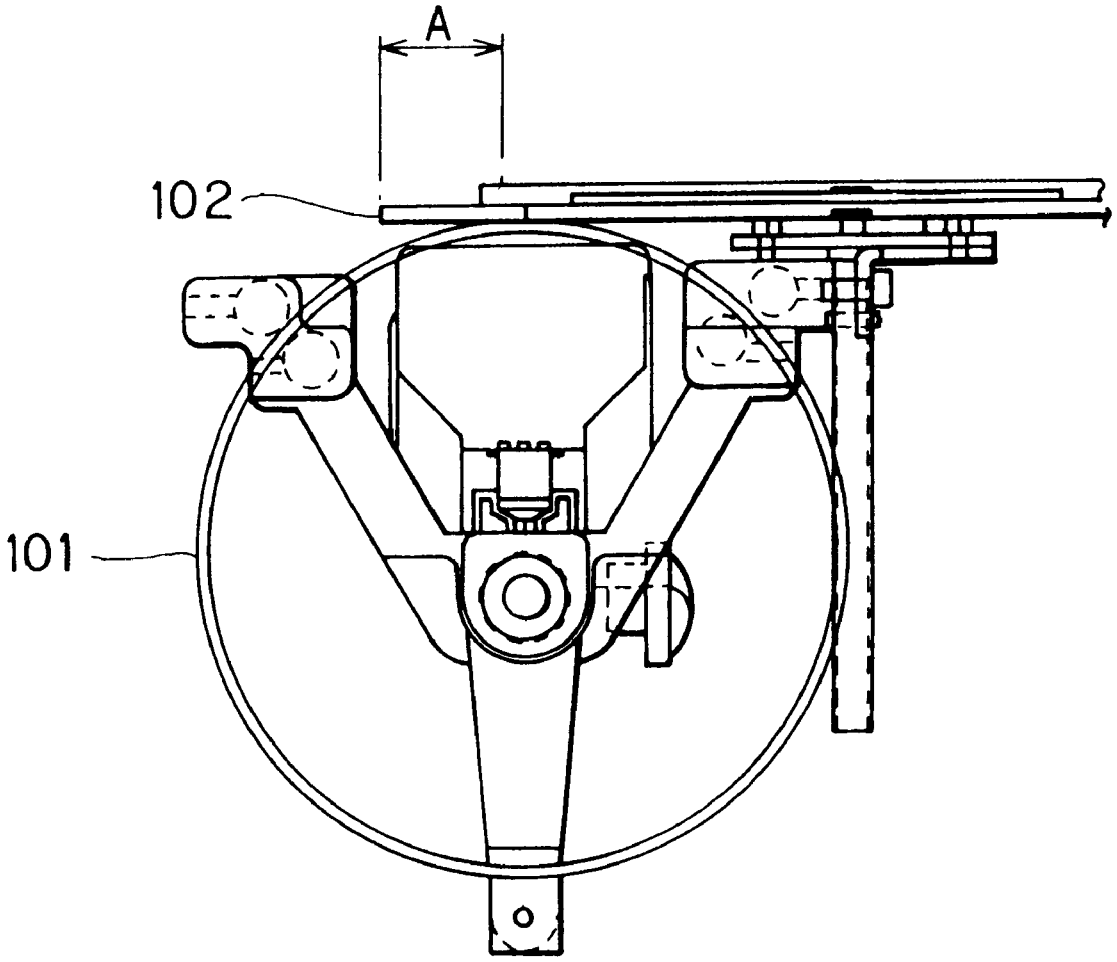
FIG. 9 is a front view showing a positional relationship between the rotary frame and a link plate which fixes a wire end in a comparative example.

Attaching portion of each end of the wire to the link plate is important for increasing rotation angle range of the rotary frame, i.e., for increasing embroidery stitching area. According to a comparative example shown in FIG. 9, assuming that the wire looped around the rotary frame 101 linearly extends to each link plate and each end of the wire is simply attached to either upper or lower surface of each link plate at a longitudinally center portion thereof without the above described hairpin curved manner, and assuming that the fabric feed frame is moved rightwardly so that the one link plate 102 attached to the fabric feed frame is positioned immediately above the rotary frame 4 as shown in FIG. 9 such that the uppermost end of the rotary frame 101 is in vertical alignment with the wire attaching point to the link plate 102. In this situation, a part of the link plate 102 corresponding to a length "A" does not contribute the rotation of the rotary frame 101. The same is true with respect to the other link plate.

Figure 8:
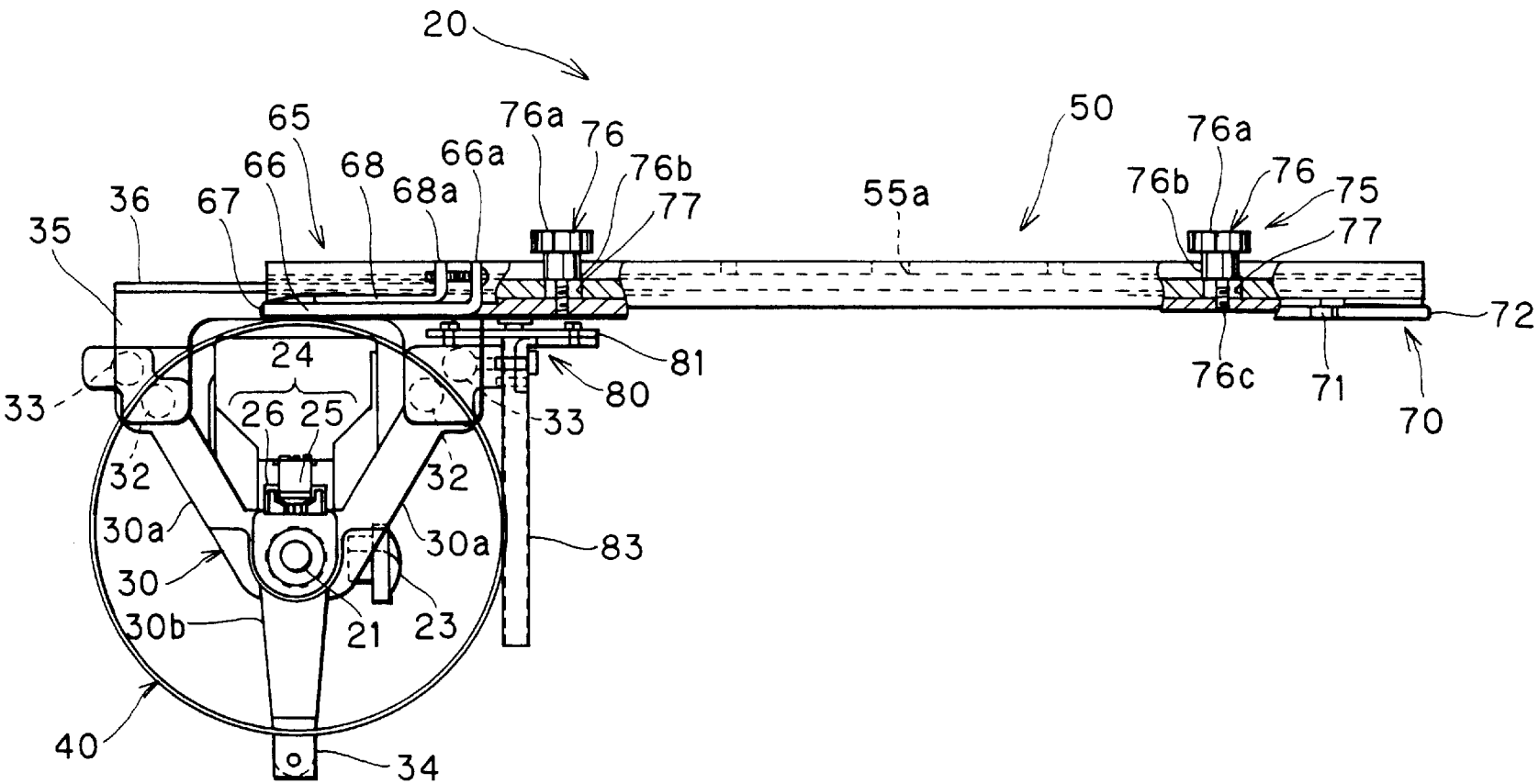
FIG. 8 is a front view showing the curved workpiece fabric holder device according to the embodiment in which a fabric feed frame is moved to its most rightward position.

In contrast, according to the depicted embodiment, the wire 51 looping around the rotary frame 40 extends from the uppermost end thereof toward the wire attaching portions 65, 70, and each of the end area portions of the wire 51 are turned at each of the outermost edges 67, 72 of the wire attaching portions 65, 70 into the hairpin manner. Therefore, as shown in FIG. 8, during embroidery stitching operation, the fabric feed frame 16 can be moved during its rightward movement so that the outermost edge 67 (i.e., leftmost edge) of the link plate 66 of the left side wire attaching portion 65 can be positioned immediately above the uppermost end of the rotary frame 40. The same is true with respect to the right side wire attaching portion 70. That is, the fabric feed frame 16 can be moved during its leftward movement so that the outermost edge 72 (i.e., rightmost edge) of the link plate 71 of the right side wire attaching portion 70 can be positioned immediately above the uppermost end of the rotary frame 40. Consequently, resultant angular rotation range of the rotary frame 40 can be increased, to thereby increase embroidery stitching area with respect to the curved workpiece fabric.

The end area portions of the wire pass underneath the link plates 66, 71, and are bent In the hairpin manner at the outermost edges 67, 72 of the link plates 66, 71, and the ends of the wire are respectively fixed to the upper surfaces of the link piece 68 and the upper surface of the link plate 71. Therefore, the wire 51 surely extends between the outermost edges 67 and 72. In other words, in case of the multiple head type embroidery machine, a distance between the neighboring cylinder beds can be reduced, yet providing a sufficient embroidery stitching area by the above described arrangement. Thus, an entirely compact multiple head type embroidery machine can be provided. Further, each wire end can be easily fixed to the link piece 68 and the link plate 71 while leading the wire up to the outer edges of the link piece 68 and the link plate 71.

Further, by properly controlling the tension of the wire 51, the rotary frame 40 can be rotated in synchronism with the movement of the fabric feed frame 16 in X-direction without any slippage of the wire 51 over the annular wire guide groove 44. Accordingly, accurate embroidery stitching can be performed.

While the invention has been described in detail and with reference to the specific embodiments thereof, it would be apparent to those skilled in the art that various changes and modifications may be made therein without departing from the spirit and scope of the invention.

What is claimed is:

1. A curved workpiece fabric holder device for use in an embroidery machine having at least one cylinder bed extending in a frontward/rearward direction, and a fabric feed frame movable in the frontward-rearward direction and a lateral direction perpendicular thereto, the holder device comprising:

a base frame positioned adjacent the at least one cylinder bed and movable in the frontward/rearward direction;

a rotary frame rotatably supported by the base frame and positioned to surround the at least one cylinder bed, the rotary frame having an uppermost end;

a workpiece retainer for retaining a curved workpiece and detachably mounted on the rotary frame; and a translation mechanism connected between the fabric feed frame and the rotary frame for translating the movement of the fabric feed frame in the lateral direction into a rotational movement of the rotary frame, the translation mechanism comprising:

a wire looping around the rotary frame and having one end area portion extending from the uppermost end of the rotary frame away from the rotary frame in the lateral direction, and having another end area portion extending from the uppermost end of the rotary frame opposite away from the rotary frame in the lateral direction, the wire having one and another distal ends;

a pair of first and second wire attaching portions spaced away from each other in the lateral direction and supported to the fabric feed frame, the first and second wire attaching portions having outermost edges in the lateral direction, the one end area portion of the wire leading up to the outermost edge of the first wire attaching portion and the one distal end of the wire being fixed to the first wire attaching portion, and the another end area portion of the wire leading up to the outermost edge of the second wire attaching portion and the another distal end of the wire being fixed to the second wire attaching portion, the one end area portion of the wire and the another end area portion of the wire being positioned below the first and second wire attaching portions until the one end area portion and the another end area portion reach the outermost edges of the first and second wire attaching portion:

a fixed segment connected to the fabric feed frame; and a movable segment movable in the lateral direction with respect to the base frame, the movable segment having an elongated shape, and having one longitudinal end portion to which the first wire attaching portion is fixed, and another longitudinal end portion to which the second wire attaching portion is fixed, the movement of the movable segment in the lateral direction being translated into the rotational movement of the rotary frame about its axis through the wire;

wherein the uppermost end of the rotary frame is positioned below the movable segment;

wherein the one and another end area portions of the wire are bent in a hairpin manner at the outermost edges so that the one distal end of the wire is fixed to an upper surface of the first wire attaching portion and the another distal end of the wire is fixed to an upper surface of the second wire attaching portion; and wherein the first wire attaching portion comprises:

a link plate extending in the lateral direction and projecting frontwardly from the movable segment at its longitudinal one end portion, the link plate having an outer longitudinal edge and an inner longitudinal end provided with an upwardly bent portion;

a movable link piece extending in the lateral direction and movable upon the link piece in the lateral direction, the link piece having an inner longitudinal end provided with an upwardly bent portion connected to the upwardly bend portion of the link plate, an outer edge, and an upper surface to which one distal end of the wire is fixed.

2. The curved workpiece fabric holder device as claimed in claim 1, wherein the one end area portion of the wire is bent at the outer longitudinal edge of the link plate.

3. The curved workpiece fabric holder device as claimed in claim 1, wherein the second wire attaching portion comprises a link plate extending in the lateral direction and projecting frontwardly from the movable segment at its longitudinal another end portion, the link plate having an outer longitudinal edge and an upper surface to which the another distal end of the wire is fixed.

4. The curved workpiece fabric holder device as claimed in claim 3, wherein the another end area portion of the wire is bent at the outer longitudinal edge of the link plate of the second wire attaching portion in a hair-pin fashion.

5. The curved workpiece fabric holder device as claimed in claim 1, wherein the upwardly bent portion of the link plate is in confrontation with the upwardly bent portion of the link piece;

and further comprising a wire tension adjusting member connected between the confronting upwardly bent portions for varying a distance therebetween to move the movable link piece relative to the link plate.

6. The curved workpiece fabric holder device as claimed in claim 1, further comprising an adjustment unit provided to at least one of the first and second wire attaching portions for adjusting a tension of the wire, the adjustment unit comprising a fixed section, a movable section movable with respect to the fixed section, and an adjusting piece for moving the movable section in the lateral direction relative to the fixed section, one of the distal ends of the wire being fixed to the movable section.

7. The curved workpiece fabric holder device as claimed in claim 6, wherein the adjusting piece comprises a screw rotatably supported on the fixed section and threadingly engaged with the movable section.

8. A multiple head type embroidery machine for performing embroidery stitching simultaneously to a plurality of curved workpiece fabrics comprising:

a plurality of embroidery heads arrayed side by side in a lateral direction, each embroidery head having a plurality of needle bars each holding a sewing needle, and a cylinder bed extending in a frontward/rearward direction and housing therein a loop taker, an embroidery stitching being formed by co-operation of the sewing needle and the loop taker;

a fabric feed frame movable in the frontward-rearward direction and a lateral direction perpendicular thereto; and a plurality of holder devices each comprising:

a base frame positioned adjacent the cylinder bed and movable in the frontward/rearward direction;

a rotary frame rotatably supported by the base frame and positioned to surround the cylinder bed, the rotary frame having an uppermost end;

a workpiece retainer for retaining a curved workpiece and detachably mounted on the rotary frame; and a translation mechanism connected between the fabric feed frame and the rotary frame for translating the movement of the fabric feed frame in the lateral direction into a rotational movement of the rotary frame, the translation mechanism comprising:

a wire looping around the rotary frame and having one end area portion extending from the uppermost end of the rotary frame away from the rotary frame in the lateral direction, and having another end area portion extending from the uppermost end of the rotary frame opposite away from the rotary frame in the lateral direction, the wire having one and another distal ends;

a pair of first and second wire attaching portions spaced away from each other in the lateral direction and supported to the fabric feed frame, the first and second wire attaching portions having outermost edges in the lateral direction, the one end area portion of the wire leading up to the outermost edge of the first wire attaching portion and the one distal end of the wire being fixed to the first wire attaching portion, and the another end area portion of the wire leading up to the outermost edge of the second wire attaching portion and the another distal end of the wire being fixed to the second wire attaching portion, the one end area portion of the wire and the another end area portion of the wire being positioned below the first and second wire attaching portions until the one end area portion and the another end area portion reach the outermost edges of the first and second wire attaching portion;

a fixed segment connected to the fabric feed frame; and a movable segment movable in the lateral direction with respect to the base frame, the movable segment having an elongated shape, and having one longitudinal end portion to which the first wire attaching portion is fixed, and another longitudinal end portion to which the second wire attaching portion is fixed, the movement of the movable segment in the lateral direction being translated into the rotational movement of the rotary frame about its axis through the wire;

wherein the uppermost end of the rotary frame is positioned below the movable segment;

wherein the one and another end area portions of the wire are bent in a hairpin manner at the outermost edges so that the one distal end of the wire is fixed to an upper surface of the first wire attaching portion and the another distal end of the wire is fixed to an upper surface of the second wire attaching portion; and wherein the first wire attaching portion comprises:

a link plate extending in the lateral direction and projecting frontwardly from the movable segment at its longitudinal one end portion, the link plate having an outer longitudinal edge and an inner longitudinal end provided with an upwardly bent portion; and a movable link piece extending in the lateral direction and movable upon the link piece in the lateral direction, the link piece having an inner longitudinal end provided with an upwardly bent portion connected to the upwardly bent portion of the link plate, an outer edge, and an upper surface to which one distal end of the wire is fixed.

9. The multiple head type embroidery machine as claimed in claim 8, wherein the one end area portion of the wire is bent at the outer longitudinal edge of the link plate.

10. The multiple head type embroidery machine as claimed in claim 8, wherein the second wire attaching portion comprises a link plate extending in the lateral direction and projecting frontwardly from the movable segment at its longitudinal another end portion, the link plate having an outer longitudinal edge and an upper surface to which the another distal end of the wire is fixed.

11. The multiple head type embroidery machine device as claimed in claim 10, wherein the another end area portion of the wire is bent at the outer longitudinal edge of the link plate of the second wire attaching portion in a hairpin fashion.

12. The multiple head type embroidery machine as claimed in claim 8, wherein the upwardly bent portion of the link plate is in confrontation with the upwardly bent portion of the link piece;

and further comprising a wire tension adjusting member connected between the confronting upwardly bent portions for varying a distance therebetween to move the movable link piece relative to the link plate.

13. The multiple head type embroidery machine as claimed in claim 8, further comprising an adjustment unit provided at least one of the first and second wire attaching portions for adjusting a tension of the wire, the adjustment unit comprising a fixed section, a movable section movable with respect to the fixed section, and an adjusting piece for moving the movable section in the lateral direction relative to the fixed section, one of the distal ends of the wire being fixed to the movable section.

14. The multiple head type embroidery machine as claimed in claim 13, wherein the adjusting piece comprises a screw rotatably supported on the fixed section and threadingly engaged with the movable section.

* * * * *